US006336896B1

(12) United States Patent
Hsu et al.

(10) Patent No.: US 6,336,896 B1
(45) Date of Patent: Jan. 8, 2002

(54) AUTOMATIC FILTER TIP ATTACHING MACHINE

(76) Inventors: Chieh-Hsueh Hsu; Chung-Yeh Hsu; Eric-Chi Hsu; Yie-Yeh Hsu, all of 6F, No. 139, Chu Kuang Road, Panchiao City, Taipei Hsien (TW)

( * ) Notice: Subject to any disclaimer, the term of this patent is extended or adjusted under 35 U.S.C. 154(b) by 0 days.

(21) Appl. No.: 09/438,772

(22) Filed: Nov. 12, 1999

(51) Int. Cl.[7] ..... B31C 13/00

(52) U.S. Cl. ..... 493/39; 493/47; 493/48; 493/42; 493/45; 493/46

(58) Field of Search ..... 131/331, 341, 131/342, 344, 94, 187, 175; 493/47, 48, 42, 45, 46, 39, 40

(56) References Cited

U.S. PATENT DOCUMENTS 3,165,953 A * 1/1965 I.T. Brown et al. ..... 83/102
3,961,633 A * 6/1976 Schubert et al. ..... 131/94
4,411,640 A * 10/1983 Hall ..... 493/45

* cited by examiner

*Primary Examiner*—James Derrington
*Assistant Examiner*—Dionne A. Walls
(74) *Attorney, Agent, or Firm*—Rosenberg, Klein & Lee

(57) ABSTRACT

An automatic filter tip attaching machine includes a mechanical structure moved by a computer program to automatically attach three filter tip stages a, b, c to cigarettes, with a chemical powder filled in the filter tip b to absorb nicotine and tar completely from cigarette smoke.

7 Claims, 11 Drawing Sheets

AUTOMATIC FILTER TIP ATTACHING MACHINE

BACKGROUND OF THE INVENTION

1. Field of the Invention

The invention relates to an automatic filter tip attaching machine, particularly to one attaching a three-stage filter tip to cigarettes automatically. The three-stage filter tip includes three plastic filters a, b, and c with nicotine absorbing chemical powder filled in the b stage to completely get rid of nicotine and toxic tar contained in cigarette smoke.

2. Prior Art

The inventor has obtained a U.S. Pat. No. 5,048,546 on Sep. 17, 1991, titled "Filter and method of treating tobacco smoke to reduce materials harmful to heath", wherein the filter contains a chemical to absorb more than 90% of the nicotine and more than 70% of the tar.

Conventional filter tips for cigarettes are classified into two kinds. One kind is the filter tip that is integrally attached to cigarettes, and the other is the type that is an independent filter tip made of wood, plastic, or metal, generally filled with active carbon, cotton fiber or something mixable with hot cigarette smoke, etc. However, these conventional filter tips do not function to completely remove nicotine or tar.

SUMMARY OF THE INVENTION

In view of the drawbacks described above, this invention has been devised to offer an automatic filter tip attaching machine.

The feature of the invention is a rotatable disc fixed on a cam divide rotator driven by a motor and a plurality of air pressure cylinders spaced apart equidistantly, and fixed on an outer circumferential edge of the rotatable disc, and an air pressure cylinder with two pairs of clamping fingers for clamping two filter tips a, b or c, orderly moved to be filled with a chemical powder in the filter tip b or fill fiber in the filter tip c and the filter tip a combined together with the filter tips b and c during intermittent rotation of the rotatable disc, controlled by the computer program.

BRIEF DESCRIPTION OF THE DRAWINGS

This invention will be better understood by referring to the accompanying drawings, wherein.

BRIEF DESCRIPTION OF THE PREFERRED EMBODIMENTS

Figure 1:
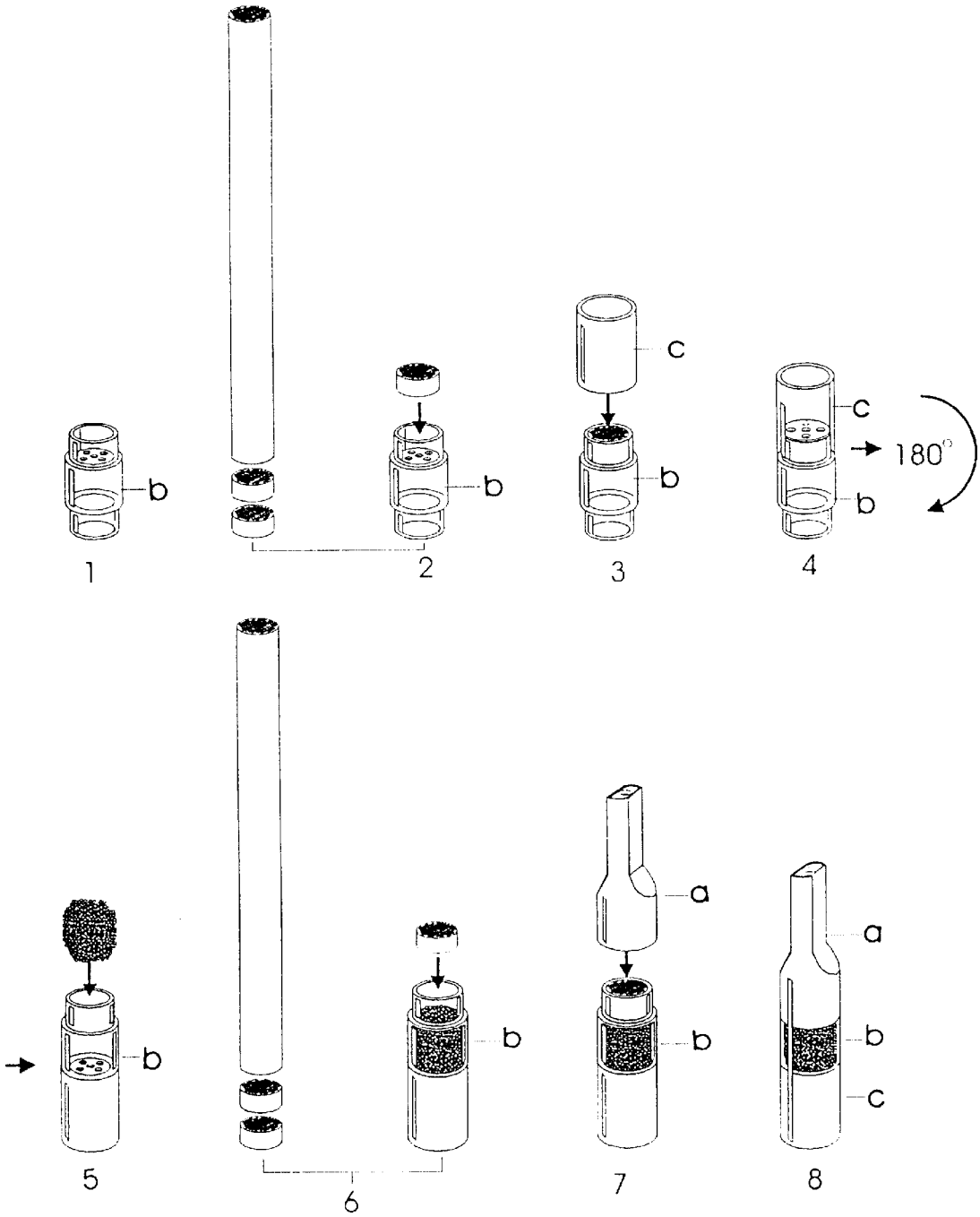
FIG. 1 is a flow chart representing eight stages of automatically making a filter tip of the present invention.

First, manufacturing processes of filter tips by an automatic filter tip attaching machine of the present invention is shown in FIG. 1 and described as below.

1. Preparing transparent plastic filter tips b;
2. Filling filter material in the filter tips b;
3. Pressing a filter tip c with a filter tip b;
4. Inverting the filter tip c together with the filter tip b, to locate the filter tip b upside down;
5. Filling chemical powder to absorb nicotine and tar in the transparent filter tip b;
6. Filling another filter material on the chemical powder filled in the filter tip b, preventing the chemical powder from falling out of the filter tip b;
7. Pressing the filter tip a and the filter tip b tightly together to become integral; and,
8. Checking and counting the finished filter tip and storing them properly.

Figure 2:
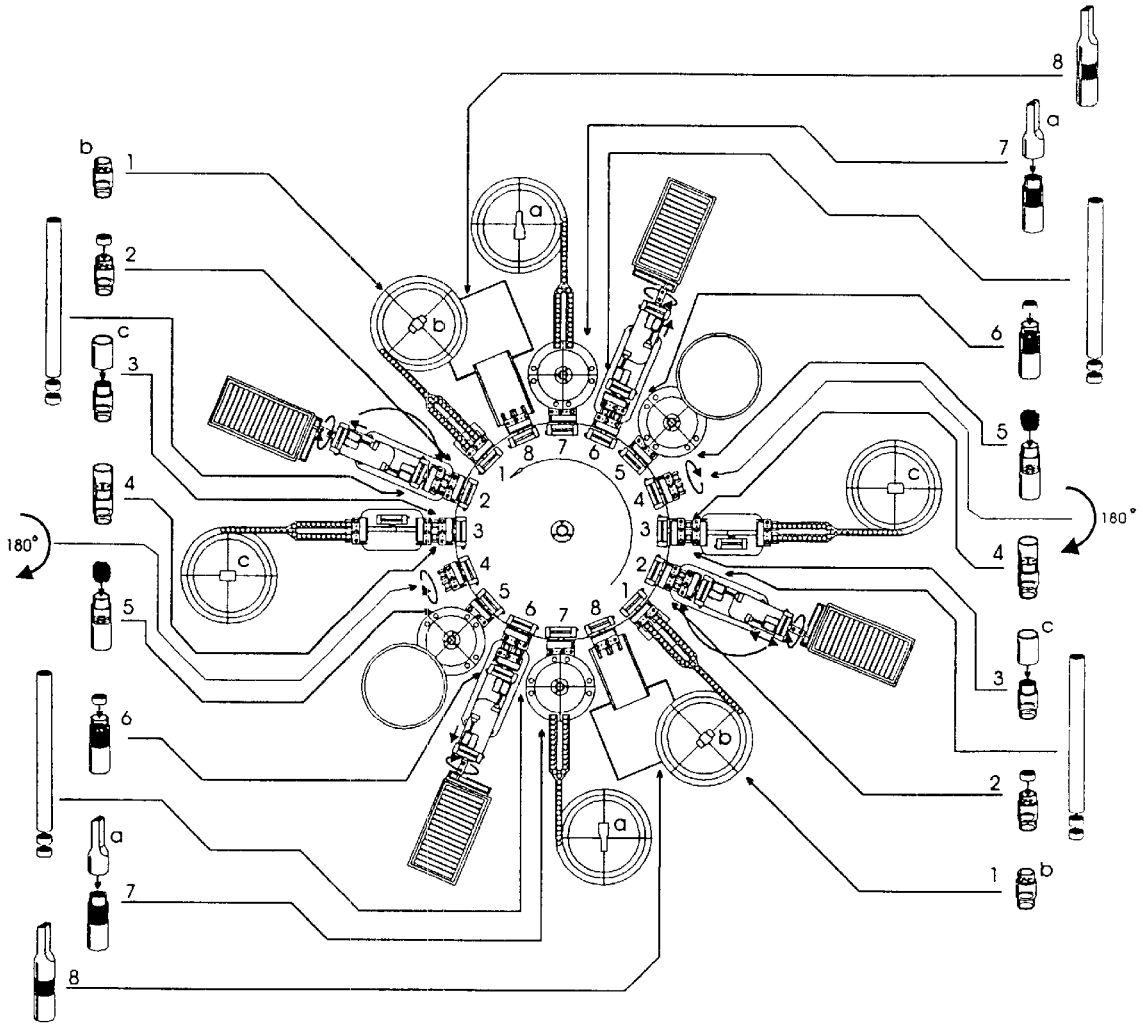
FIG. 2 is an upper view of an automatic filter tip attaching machine, with eight stations for a group A and eight stations for a group B.
Figure 3:
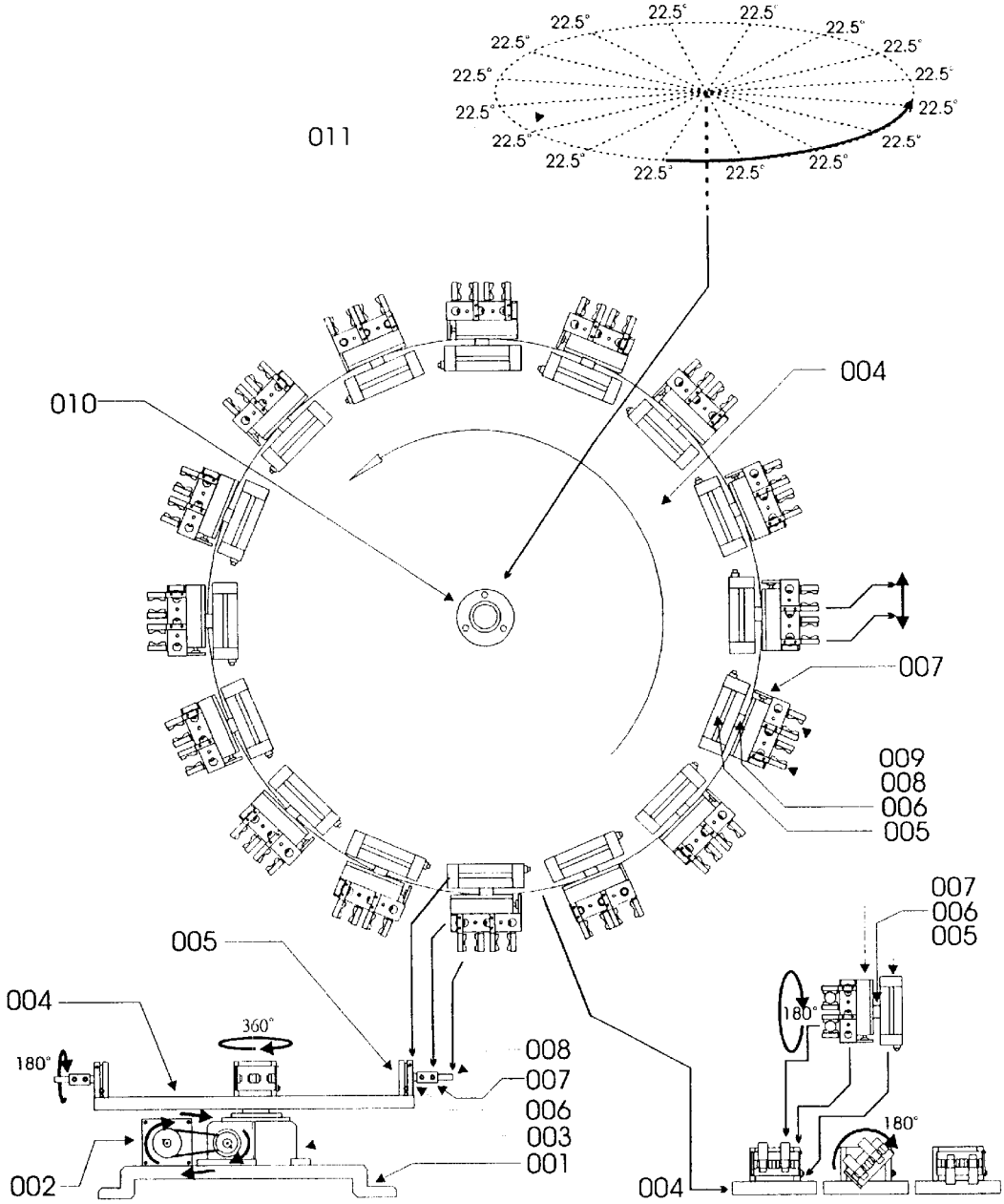
FIG. 3 is an upper view showing a cam divide rotator rotating a rotatable disc with plural air pressure cylinders with clamping fingers of the present invention.

In order to accomplish the above processes, the automatic filter tip attaching machine of the present invention, shown in FIGS. 2 and 3, includes a rotatable disc 004 divided into 16 sections, 16 air pressure cylinders 005 positioned around the outer circumferential edge of the rotatable disc 004 and are rotatable through 180 degrees. Each air pressure cylinder has a shaft 006 connected to another air pressure cylinder for moving two pairs of clamp fingers 008, 009 to catch different sections of filter tips and cigarettes. The rotatable disc 004 has 16 work stations, and the manufacturing process for completing the filter tips needs 8 stations, so the rotatable disc 004 has two units of automatic filter tip attaching work stations.

Figure 4:
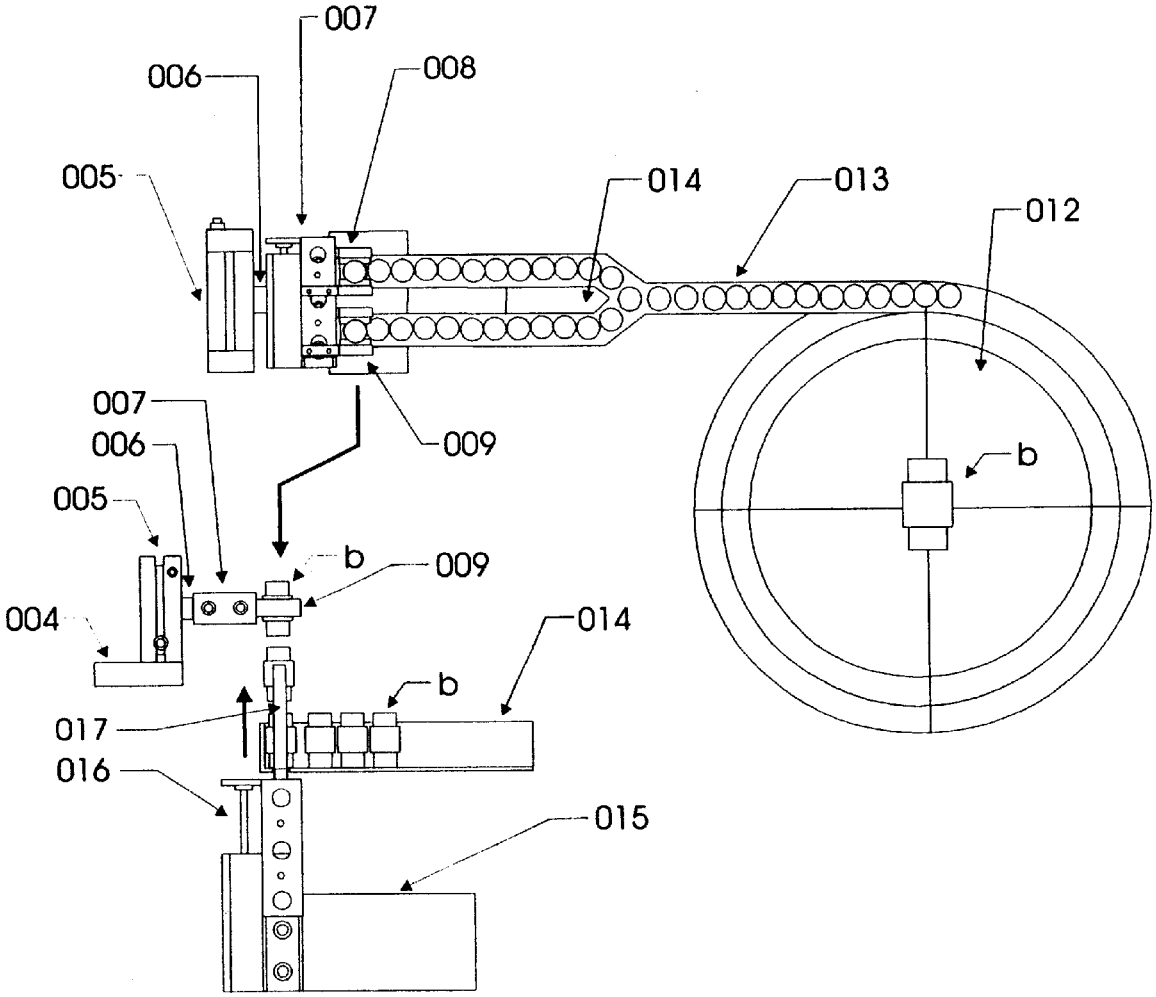
FIG. 4 is a side view showing a filter tip b feeding device and two pairs of clamp fingers of each air pressure cylinder of the present invention.

The filter work station has a filter tip feeding device 012 moving filter tips b arranged in a row to be clamped by the two pairs of clamp fingers 008, 009 of the first work station, as shown in FIGS. 3 and 4. At this time, the rotatable disc 004 rotates for 22.5 degrees as shown in FIG. 3, permitting the air pressure cylinder 004 with the filter tips b to then face the second work station.

Figure 5:
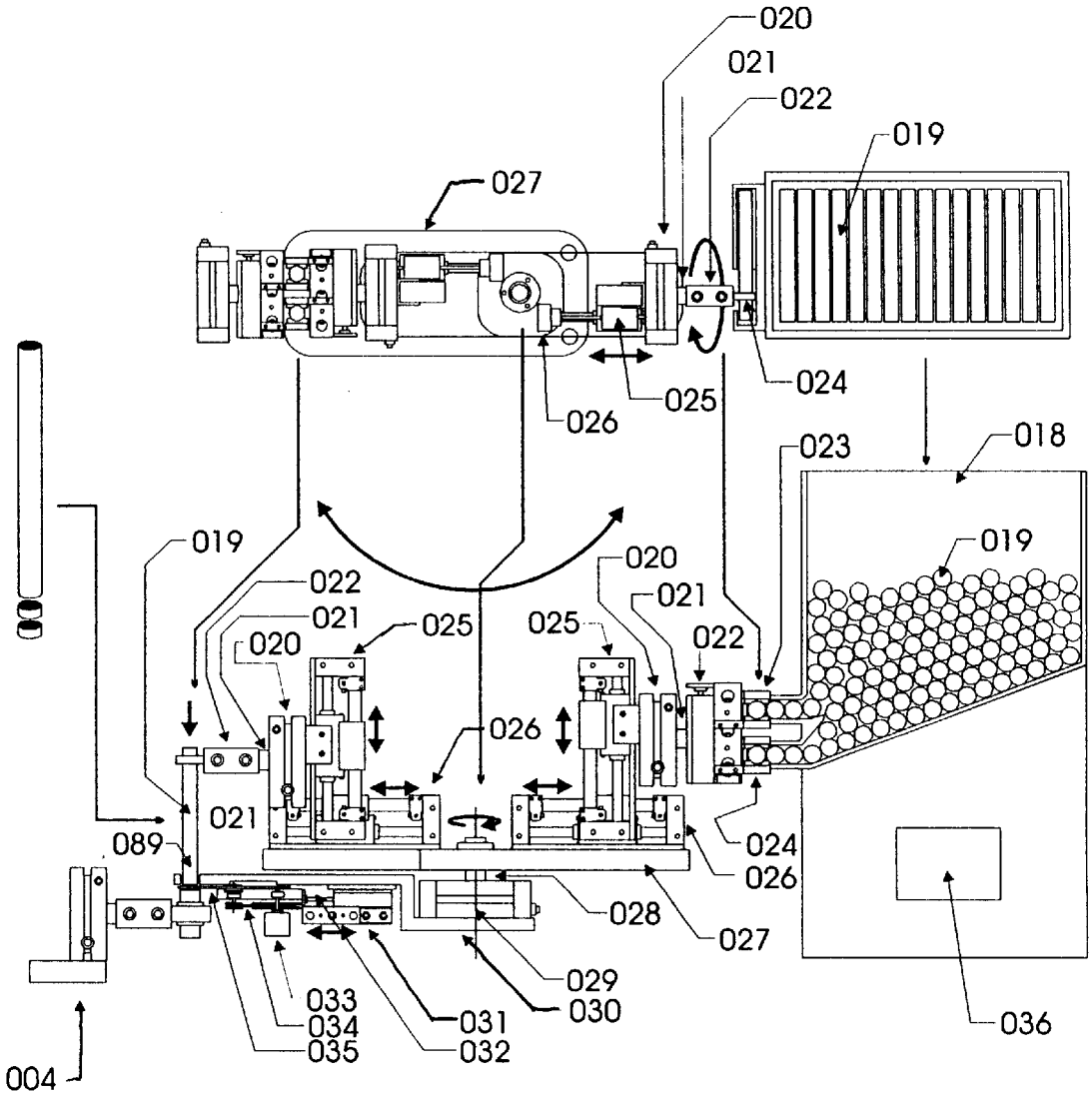
FIG. 5 is a side view showing a filter tip bar being fed into and cut by the machine of the present invention.

The second work station cuts the fiber filter material and presses the cut fiber filter material into one end of the filter tips b as shown in FIG. 5, with the rotatable disc rotating a further 22.5 degrees to move to the third work station.

Figure 6:
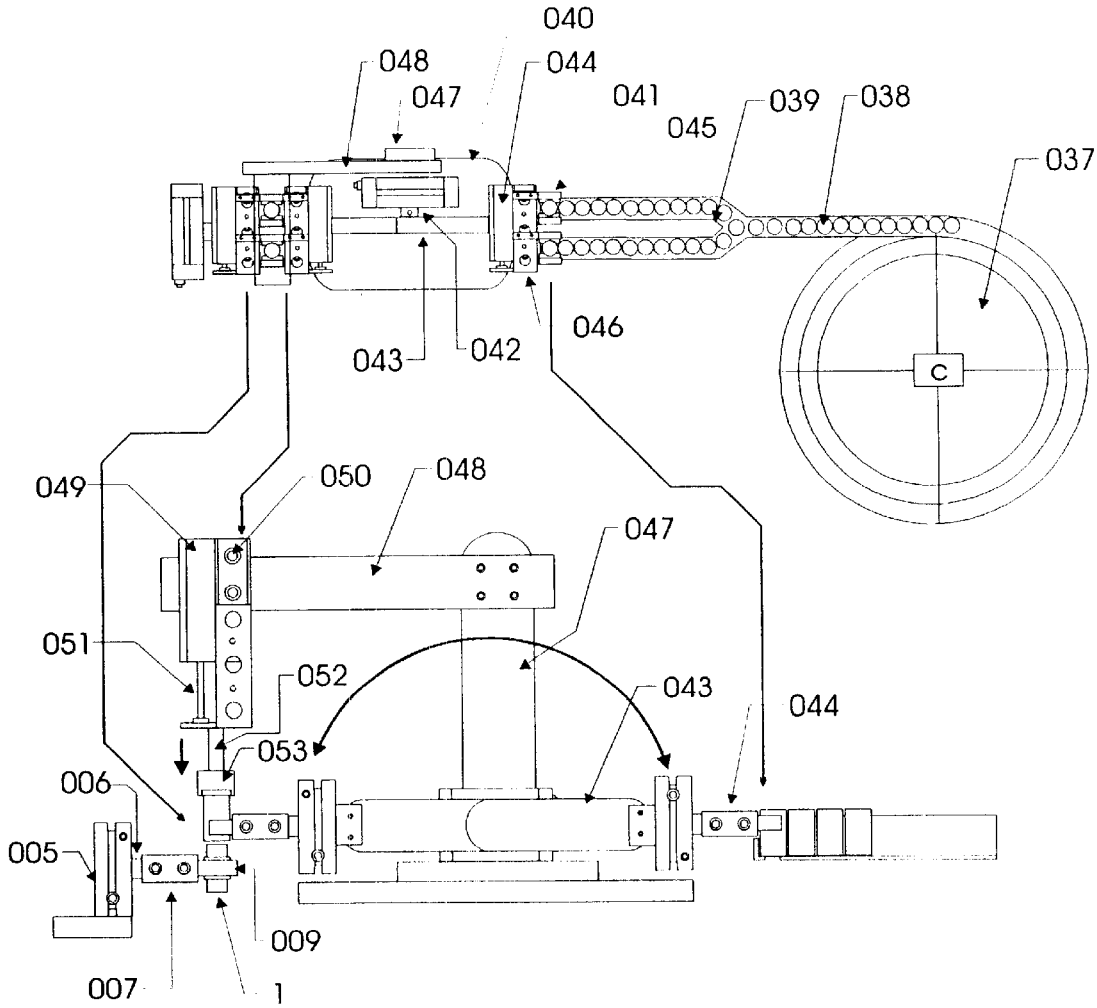
FIG. 6 is an upper view showing filter tips c and b being pressed together in the present invention.

The third work station moves the filter tips c to two pairs of clamp fingers 045, 046 of a robot arm 043 to be clamped, and then inverted, rotated through 180 degrees and moved down by the air pressure cylinder 049 to tightly combine the filter tips c with respective filter tips b. The robot arm 043 then rotates back through 180 degrees to the original position as shown in FIG. 6, and the rotatable disc 004 then rotates a further 22.5 degrees to move to the fourth work station.

Figure 7:
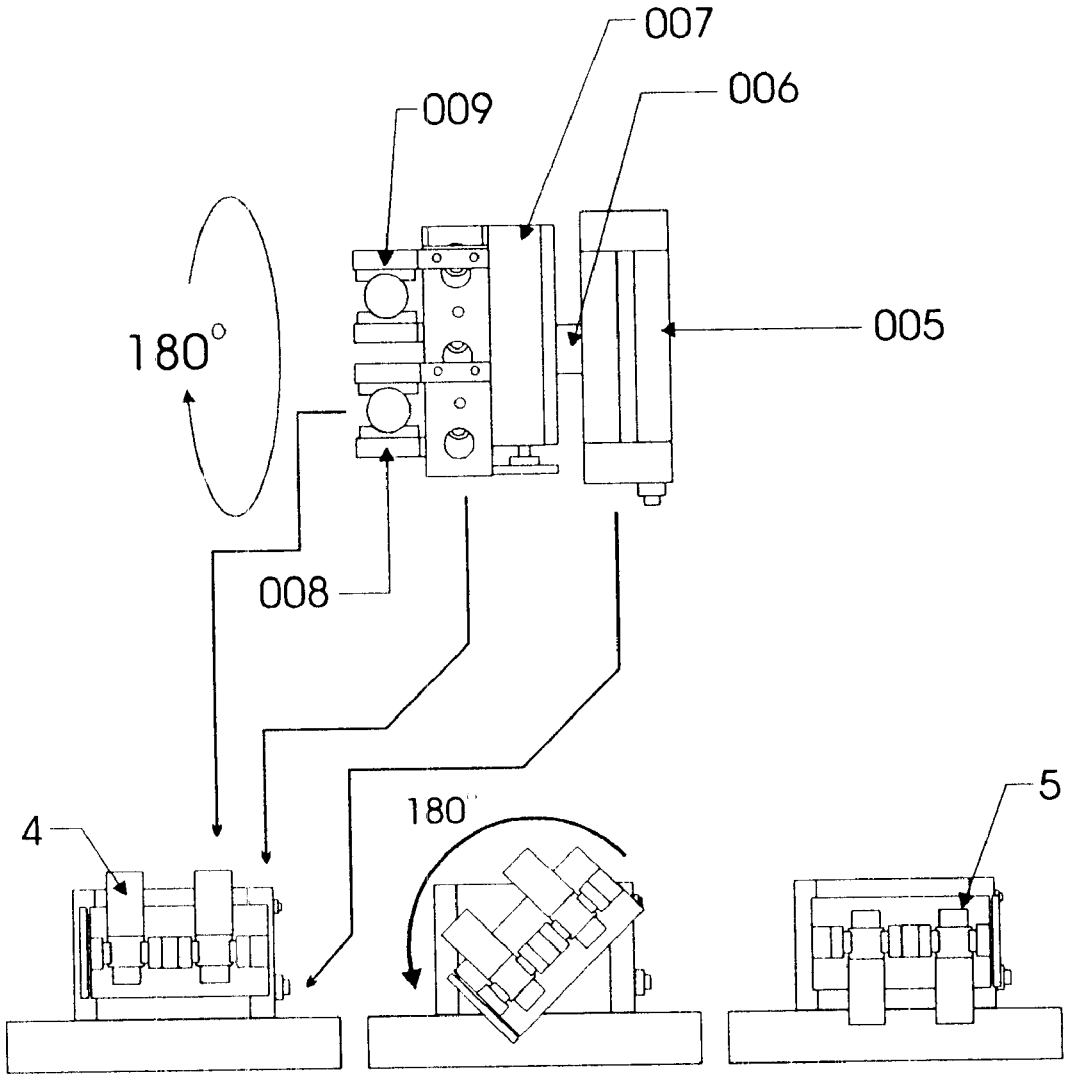
FIG. 7 is a side view showing the filter tips b and c being pressed together and then inverted upside down by the clamp fingers of the air pressure cylinder of the present invention.

The fourth work station inverts the filter tips c combined with b through 180 degrees to position the filter tips b facing upward, as shown in FIG. 7, and then the rotatable disc turns a further 22.5 degrees to move to the fifth work station.

Figure 8:
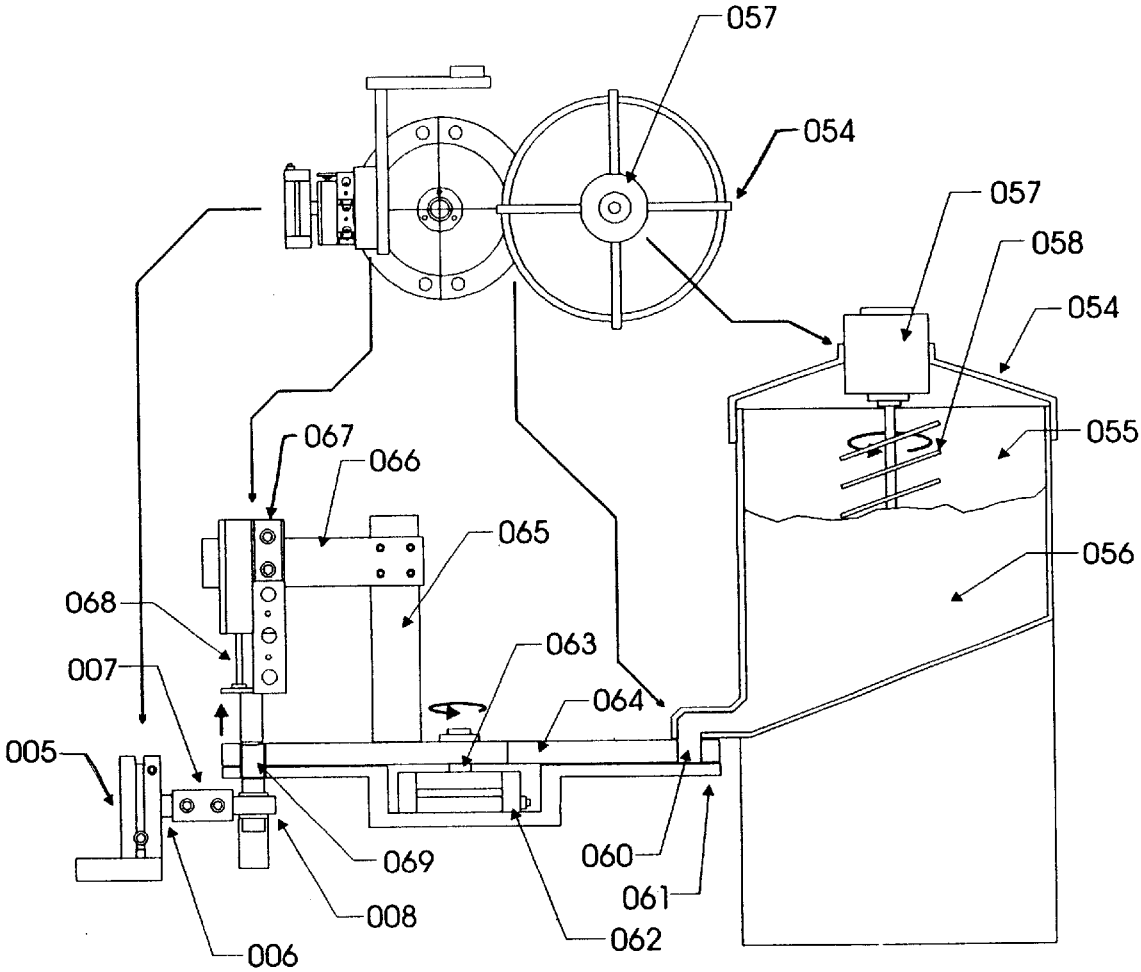
FIG. 8 is a side view showing chemical powder being pressed into the transparent filter tip b of the present invention.

Next, the fifth work station fills a chemical powder in an upper end of the filter tips b for absorbing nicotine and tar in cigarette smoke, as shown in FIG. 8. The rotatable disc then turns another 22.5 degrees to move to the sixth work station.

Figure 9:
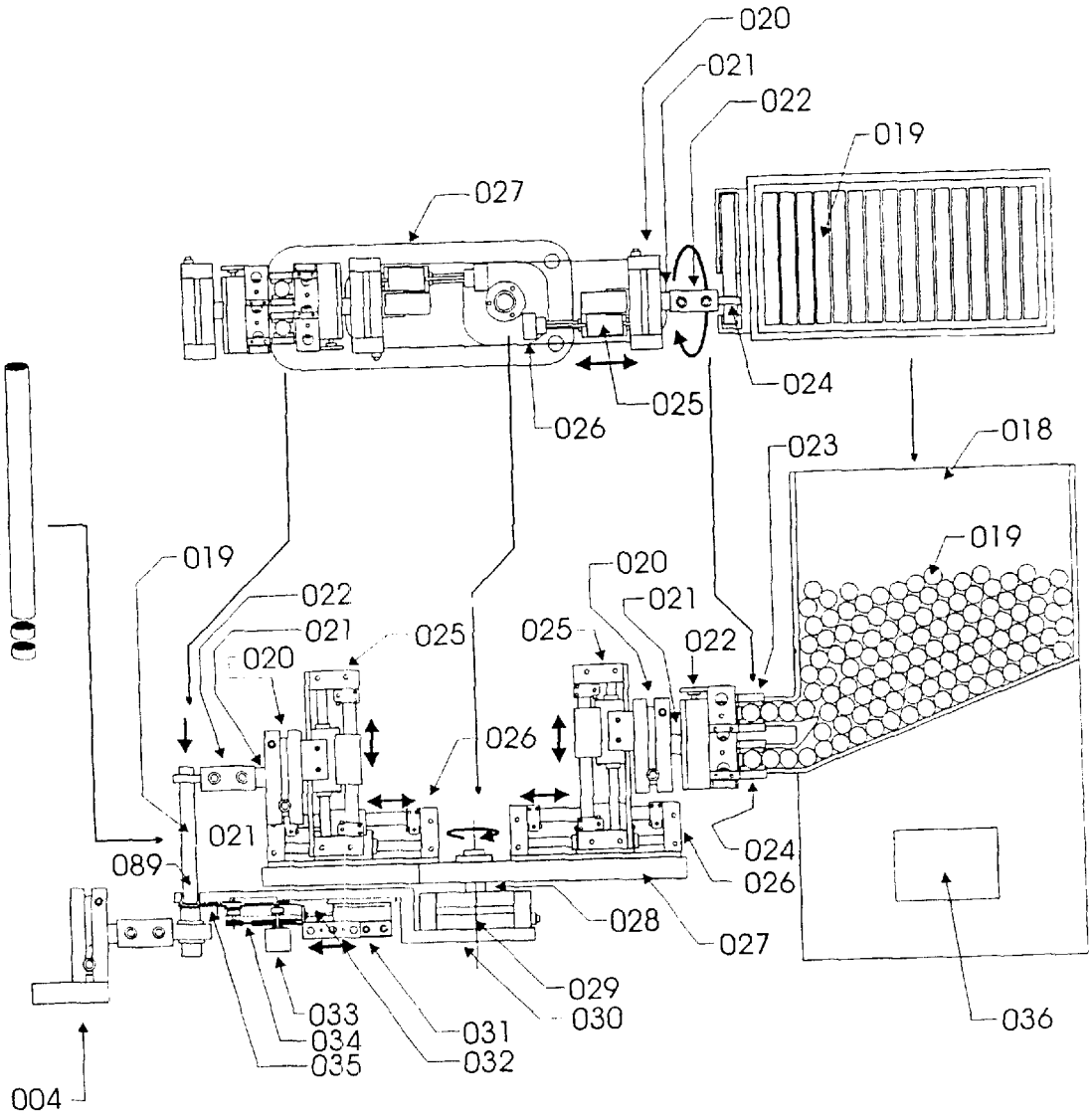
FIG. 9 is a side view showing the filter tip material cut for the second time and pressed into the other end of the filter tip b of the present invention.

At the sixth work station a fiber filter material is cut and pressed into the other end of the filter tip b as shown in FIG. 9, with the rotatable disc 004 then rotating another 22.5 degrees, to move to the seventh work station.

Figure 10:
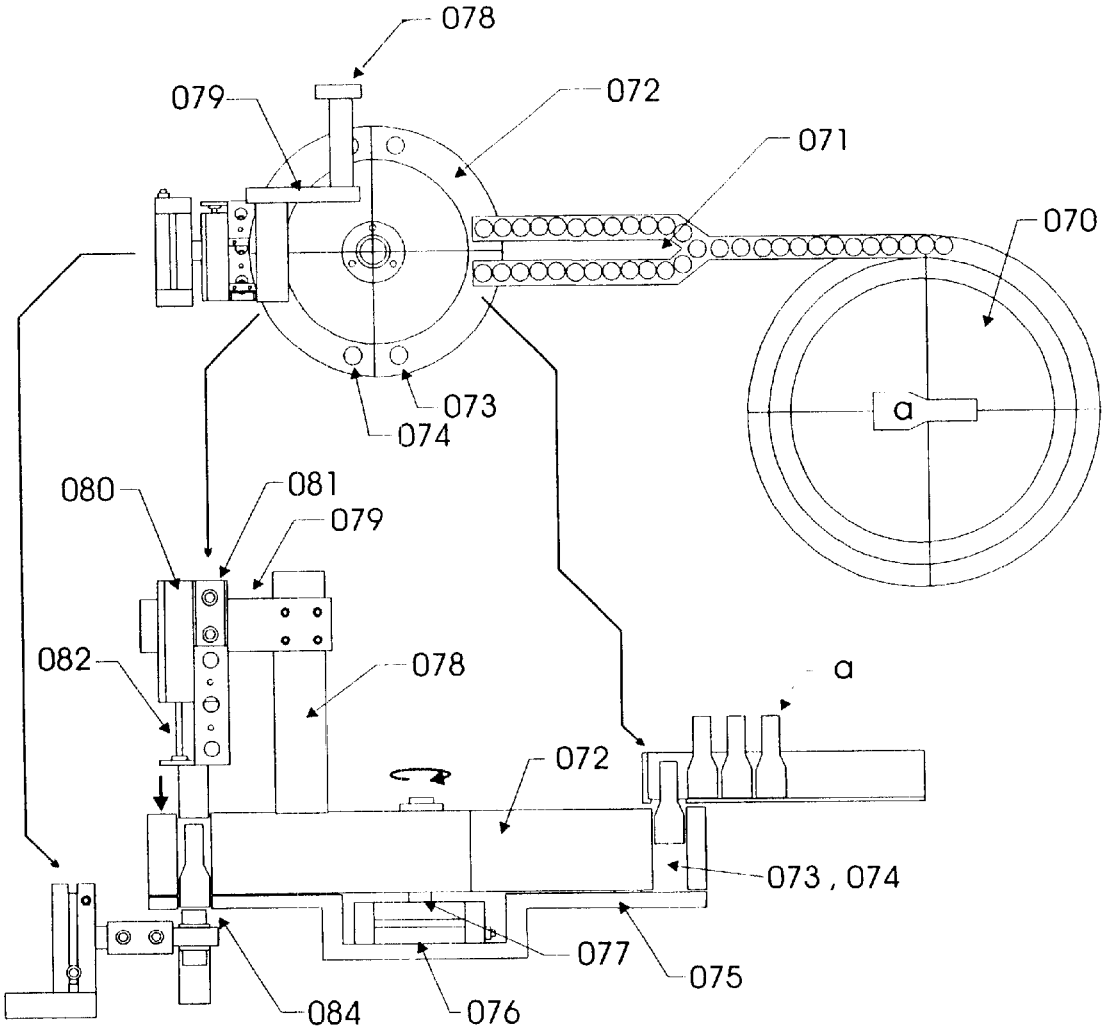
FIG. 10 is a side view showing the filter tip a being pressed together with an upper end of the filter tip b of the present invention.

The seventh work station moves the filter tips a to an inlet of the rotatable position disc 072 by a material transporter 070, and then rotates through 90 degrees to align with the filter tips b. The filter tips a are then tightly combined with the filter tips b by a robot arm 080, as shown in FIG. 10. The rotatable disc then rotates another 22.5 degrees to move to the eighth work station.

Figure 11:
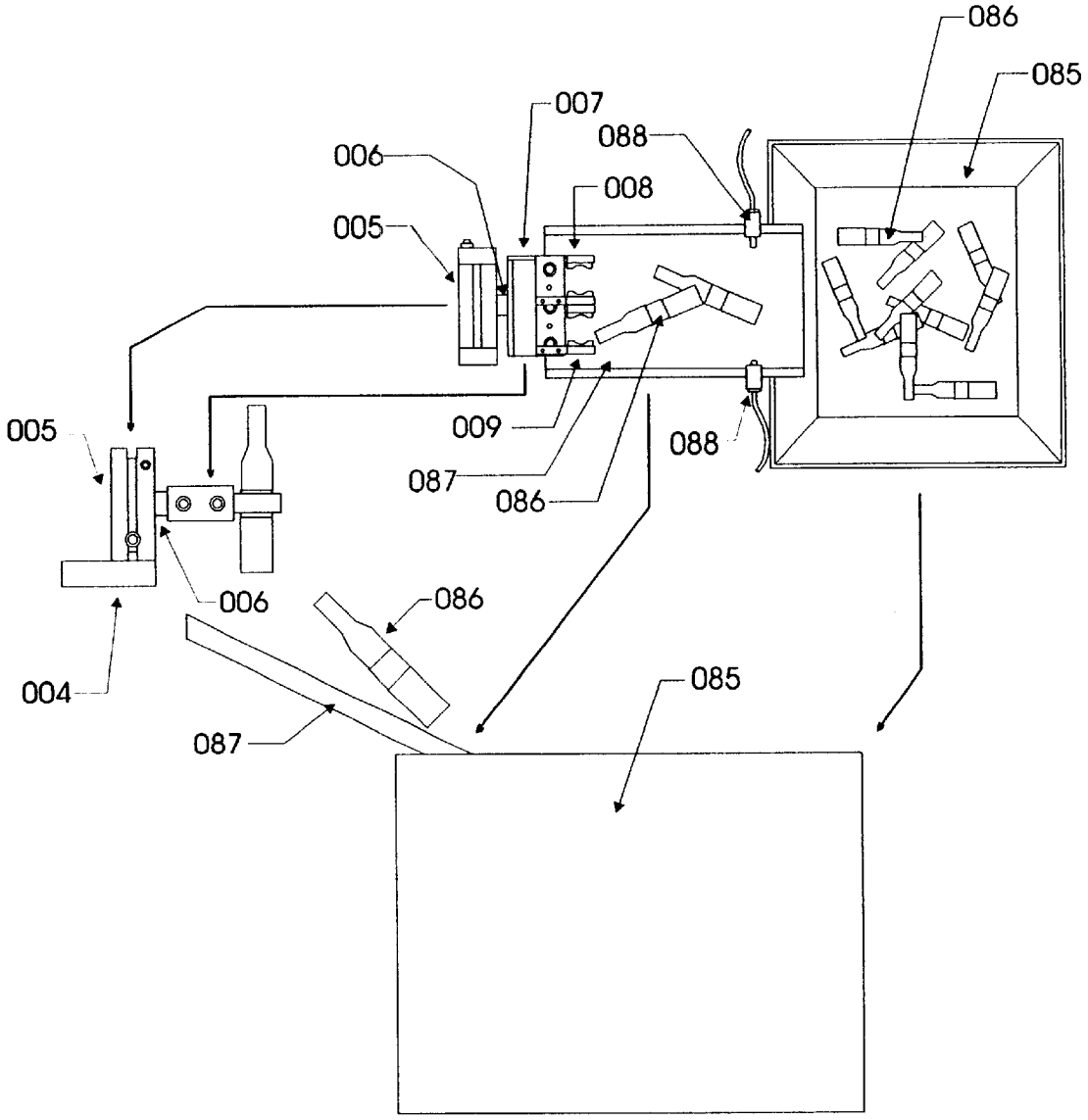
FIG. 11 is a side view showing the finished filter a, b and c being counted, checked and collected in a container of the present invention.

Finished filter tips are checked and counted at the eighth work station, and then slid down a sloped plate 087 into a collection container 085, as shown in FIG. 11.

Next, the detailed structure will be described with reference to FIG. 3. The rotatable disc 004 is fixed on the cam divide rotator 003 driven by a motor 002, and all those components are positioned on a base 001. Then 16 air pressure cylinders 05 are positioned to be spaced apart equidistantly around an outer circumferential edge of the rotatable disc 004, and are rotatable through 180 degrees. Each air pressure cylinder 05 has a rotating shaft 006 connected to another air pressure cylinder to move two pairs of clamp fingers 008, 009 to clamp the filter tips a, b, c and then move them to each work station for automatic combination.

FIG. 4 shows the first work station where the filter tips b are arranged by a vibrating feeder 12 and moved to a guide rail 013 and then to a forked guide rail 014, on which the filter tips b are moved to the left end of the rail 014. Then, the filter tips b are clamped in the clamp fingers 008, 009, and then the rotatable disc 004 turns a further 22.5 degrees to move to the next second work station.

FIG. 5 shows the second work station, where filter bars 019, stored in a storage tank 018, are moved by a vibrator 036 to two outlets 023, 024. The filter bars 019 are then clamped by the clamp fingers 008, 009 of an air pressure cylinder 022, and then rotated for 90 degrees by the air pressure cylinder 020. Then, an air pressure cylinder 029 rotates a rotatable base plate 027 through 180 degrees to align the filter bar 019 with a hole 089. The filter bar 019 is pressed in one end of a filter tip b and then cut off by a circular saw 035. The thickness of the filter bar 019 to be cut is controlled by a linear air pressure cylinder 025. Then, the rotatable disc turns another 22.5 degrees o move to the third work station.

FIG. 6 shows the third work station, where filter tips c stored in a vibrating storage tank 037 are arranged to move along guide rails 038, 039, to be clamped by clamp fingers 045, 06 of an air pressure cylinder 044. Then, an air pressure cylinder 041 on a base 040 moves an arm 043 reversibly through 180 degrees to align filter tips c with an upper end of respective filter tips b. The filter tips c are then pressed into a lower cap 053 to be combined with corresponding filter tips b. After that the arm 043 is rotated back through 180 degrees to the original position, ready for the next cycle.

FIG. 7 shows the fourth work station, where the air pressure cylinders 005 together with the shaft 006 and the air pressure cylinder 007 with the clamp fingers 008, 009 are rotated through 180 degrees, to invert the filter tips b, the filter tips c then being faced downwardly.

FIG. 8 shows the fifth work station, where chemical powder, stored in a storage tank 054, is moved by spring leaves 058 by a motor 057 to fall through an outlet 059 into a funnel inlet 060. Then, a feeding disc 064 is rotated by the air pressure cylinder 062 to align the inlet 060 with the upper end of a respective filter tip b. Then the chemical powder 069 is pressed into the filter tip b. Then the disc 064 is rotated through 90 degrees, and then a further 90 degrees, to fill the powder into another filter tip b.

FIG. 9 shows the sixth work station, where filter bars 019 stored in the storage tank 018 are moved by the vibrator 036 to the two outlets 023, 024. Two filter bars 019 are clamped in the clamp fingers of the air pressure cylinder 022 and then rotated through 90 degrees by the air pressure cylinder 020, and then further rotated through 180 degrees by the air pressure cylinder 029, and also rotating the base plate 027 to align the filter bars 019 with a corresponding hole 089. The filter bars 019 are then pressed into the upper end of the filter tips b, and then are cut by the circular saw 035. The thickness of the cut of the filter bar is controlled by the linear air pressure cylinder 025. Then, the rotatable disc rotates another 22.5 degrees to the next work station.

FIG. 10 shows the seventh work station, where filter tips a, in the vibrating store tank 070, are arranged by vibration to move on the guide rail 071 to drop two filter tips into inlets 073, 074 of the position rotating disc 072, which moves once through 90 degrees by an air pressure cylinder 076 under the rotating disc 072. The rotating disc 072 has four pairs of inlets 073, 074. then, an air pressure cylinder 080 presses down, and a piston rod 082 presses the filter tips a to be tightly combined with the filter tips b, finishing a complete filter tip having a, b, and c stages all combined together.

FIG. 11 shows the eighth work station, where finished filter tips passing from the first to seventh work station are released from the clamp fingers 008, 009 to slide down the sloped plate 087, to then be checked and counted by the check device 086 and the counter 088, and then fall into the collection container 085.

As can be understood in the aforesaid description, the automatic filter tip attaching machine has advantages of hygiene, time-saving and labor-saving.

What is claimed is:

1. An automatic filter tip making machine comprising:

a rotatable disc adapted to intermittently rotate in predetermined angular increments;

a plurality of first air pressure cylinders equidistantly spaced around an outer circumferential edge of said rotatable disc and affixed thereto, each of said plurality of first air pressure cylinders being rotatable through 180 degrees;

a plurality of pairs of first clamp fingers spaced around said outer circumferential edge of said rotatable disc and extending therefrom, said plurality of pairs of first clamp fingers being respectively operatively coupled to said plurality of first air pressure cylinders;

a first device disposed adjacent said outer circumferential edge of said disc for supplying a filter tip b to a corresponding pair of said pairs of first clamp fingers;

a second device disposed adjacent said outer circumferential edge of said disc and angularly spaced from said first device by said predetermined angular increment, said second device including at least a pair of second clamp fingers for clamping fiber filter material supplied thereto, said pair of second clamp fingers being displaceable to insert said fiber filter material into a respective filter tip b;

a third device disposed adjacent said outer circumferential edge of said disc and angularly spaced from said second device by said predetermined angular increment, said third device including at least a pair of third clamp fingers for clamping a respective filter tip c supplied thereto, said pair of third clamp fingers being displaceable into alignment with a respective filter tip b and a second air pressure cylinder for pressing said filter tip c into coupling engagement with said filter tip b;

a fourth device including a plurality of third air pressure cylinders respectively coupled to said plurality of first air pressure cylinders for rotating said plurality of first air pressure cylinders through 180 degrees to invert said coupled filter tips b and filter tip c and direct a lower end of said filter tip b upwardly;

a fifth device disposed adjacent said outer circumferential edge of said disc and angularly spaced from said third device by two of said predetermined angular increments, said fifth device including a vibrator and a feeding disk for dispensing a chemical powder to said lower end of a respective filter tip b;

a sixth device disposed adjacent said outer circumferential edge of said disc and angularly spaced from said fifth device by said predetermined angular increment, said sixth device including at least a pair of fourth clamp fingers for clamping fiber filter material supplied thereto, said pair of fourth clamp fingers being displaceable to insert said fiber filter material into said lower end of a respective filter tip b;

a seventh device disposed adjacent said outer circumferential edge of said disc and angularly spaced from said sixth device by said predetermined angular increment, said seventh device including at least a pair of fifth clamp fingers for clamping a respective filter tip a supplied thereto, said pair of fifth clamp fingers being displaceable into alignment with said lower end of a respective filter tip b and a fourth air pressure cylinder for pressing said filter tip a into coupling engagement with said lower end of said filter tip b to form a three stage filter; and, a eighth device disposed adjacent said outer circumferential edge of said disc and angularly spaced from said seventh device by said predetermined angular increment, said eighth device receiving said three stage filter from a respective pair of first clamp fingers, said eighth device including means for checking and counting said three stage filters received thereby.

2. The automatic filter tip making machine as claimed in claim 1, wherein said rotatable disc includes a motor drivingly coupled thereto for intermittently rotating said rotatable disc through said predetermined angular increments, said predetermined angular increments each equaling 22.5 degrees.

3. The automatic filter tip making machine as claimed in claim 1, wherein each said first, third, and seventh device each includes a vibrational material mover and guide rails for arranging and moving corresponding filter tips to respective first, third and fifth clamp fingers.

4. The automatic filter tip making machine as claimed in claim 1, wherein said fiber filter material supplied to said second and fourth clamp fingers is formed in a bar, each of said second and sixth device further include a circular saw for cutting off a portion of said bar subsequent to said bar being inserted into a respective portion of filter tip b.

5. The automatic filter tip making machine as claimed in claim 1, wherein said eighth device includes a sloped plate leading to a storage container for directing said three stage filters thereto, a sensor for checking said three stage filters , and a counter for counting said three stage filters supplied to said storage container.

6. The automatic filter tip making machine as claimed in claim 1, wherein said fifth device includes a storage tank containing said chemical powder and spring leaves within said storage tank vibrated by said vibrator thereof for evenly filling a predetermined quantity of said chemical powder into receptacles of said feeding disk.

7. The automatic filter tip making machine as claimed in claim 1, wherein said chemical powder absorbs nicotine and tar from a cigarette.

* * * * *